US008051840B2

(12) United States Patent
Cushing

(10) Patent No.: US 8,051,840 B2
(45) Date of Patent: Nov. 8, 2011

(54) APPARATUS FOR REDUCING FUEL WAXING

(75) Inventor: Timothy J. Cushing, Howell, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 329 days.

(21) Appl. No.: 12/421,900

(22) Filed: Apr. 10, 2009

(65) Prior Publication Data

US 2010/0258090 A1 Oct. 14, 2010

(51) Int. Cl.
*F02G 5/00* (2006.01)
*F02G 5/02* (2006.01)

(52) U.S. Cl. ..... 123/557; 123/196 A

(58) Field of Classification Search ..... 123/196 A, 123/298, 557; 210/144, 748.01, 748.02, 210/785, 184
See application file for complete search history.

(56) References Cited

U.S. PATENT DOCUMENTS 3,803,547 A 4/1974 Massa
4,105,004 A * 8/1978 Asai et al. ..... 123/470
4,401,089 A * 8/1983 Csaszar et al. ..... 123/536
4,411,240 A 10/1983 Kravetz
4,500,475 A * 2/1985 Csaszar et al. ..... 261/36.2
4,742,810 A * 5/1988 Anders et al. ..... 123/538
4,984,550 A * 1/1991 Toczyski et al. ..... 123/478
5,110,460 A 5/1992 Gilas
2006/0254133 A1 * 11/2006 Rudolph et al. ..... 44/605

* cited by examiner

*Primary Examiner* — Mahmoud Gimie

(74) *Attorney, Agent, or Firm* — Cantor Colburn LLP

(57) ABSTRACT

A fuel filter for an internal combustion engine is provided comprising a fuel conduit configured to transport fuel from a fuel tank to an internal combustion engine. A fuel filter manifold has an inlet and an outlet for fluid communication with the fuel conduit. A fuel filter housing is associated with the fuel filter manifold and is configured to receive fuel from and dispense fuel to the fuel filter manifold. A filter element is disposed within the fuel filter housing between the inlet and the outlet and is configured to filter fuel passing through the fuel filter housing. An electromagnetic transducer is associated with the fuel filter and is configured to emit high frequency waves operable on the fuel to reduce, via ultrasonic cavitation, wax crystals suspended in the fuel.

16 Claims, 2 Drawing Sheets

APPARATUS FOR REDUCING FUEL WAXING

FIELD OF THE INVENTION

Exemplary embodiments of the present invention are related to a fuel supply system for an internal combustion engine and, more specifically, to an apparatus for preventing blockage of a fuel filter element due to wax crystallization of the fuel at low temperatures.

BACKGROUND

Fuels for internal combustion engines such as diesel fuel, kerosene, light oil, bio-fuels or a combination thereof may include a wax component that is subject to crystallization ("waxing") at temperatures below approximately −10 degrees Celsius. Suspended wax crystals can adhere to or be trapped by the filter media of a fuel filter resulting in partial or complete blockage of the fuel filter. Such blockage of the fuel filter may result in interruption of fuel flow to the engine resulting in a reduction of engine output or stalling of the engine.

Attempts to alleviate waxing problems inherent with such fuels have involved the application of heating elements in the fuel system supplying the engine. Such heating elements may include fuel tank or fuel line heaters as well as engine block heaters or heat exchangers. Recirculation of heated fuel from the fuel injection system to the fuel tank has also been utilized. While these and other methods for avoiding waxing of the fuel have met with some success, the devices utilize significant energy thereby reducing the efficiency of the engine, are costly and may not operate rapidly enough, especially following a cold engine start because the entire volume of fuel is subject to heating rather than directly addressing the wax crystals suspend therein.

Accordingly, it is desirable to provide an apparatus that is effective to eliminate obstruction of diesel fuel filters caused by fuel wax crystallization and that is efficient and effective across the entire operational temperature range of the engine.

SUMMARY OF THE INVENTION

In one exemplary embodiment of the present invention, a fuel filter assembly for filtering fuel for an internal combustion engine comprises an ultrasonic transducer configured to emit high frequency acoustic or pressure waves that impact wax crystals suspended in the fuel to reduce the size of the wax crystals via ultrasonic cavitation.

In another exemplary embodiment of the present invention, a fuel system for an internal combustion engine comprises a fuel reservoir and a fuel pump configured to withdraw fuel from the fuel reservoir through a fuel conduit fluidly communicating the fuel reservoir and the fuel pump. A fuel filter in fluid communication with the fuel conduit comprises a fuel manifold having a fuel inlet and a fuel outlet for receipt of fuel from the fuel conduit and return of fuel to the fuel conduit. An ultrasonic transducer is associated with the fuel filter manifold and is configured to emit high frequency acoustic or pressure waves that are operable on the fuel to reduce the size of wax crystals suspended in the fuel via ultrasonic cavitation.

In yet another exemplary embodiment of the present invention, a fuel system for an internal combustion engine comprises a fuel reservoir and a fuel pump for withdrawal of fuel from the fuel reservoir through a fuel conduit fluidly communicating the fuel reservoir and the fuel pump. A fuel filter in fluid communication with the fuel conduit comprises a fuel inlet and a fuel outlet for receipt of fuel from the fuel conduit and return of fuel to the fuel conduit. An ultrasonic transducer disposed adjacent to the fuel inlet and configured to emit high frequency acoustic or pressure waves is operable on wax crystals suspended in the fuel to reduce the size of the wax crystals via ultrasonic cavitation.

The above features and advantages and other features and advantages of the present invention are readily apparent from the following detailed description of the best modes for carrying out the invention when taken in connection with the accompanying drawings.

BRIEF DESCRIPTION OF THE DRAWINGS

Other objects, features, advantages and details appear, by way of example only, in the following detailed description of embodiments, the detailed description referring to the drawings in which.

DESCRIPTION OF THE EMBODIMENTS

Figure 1:
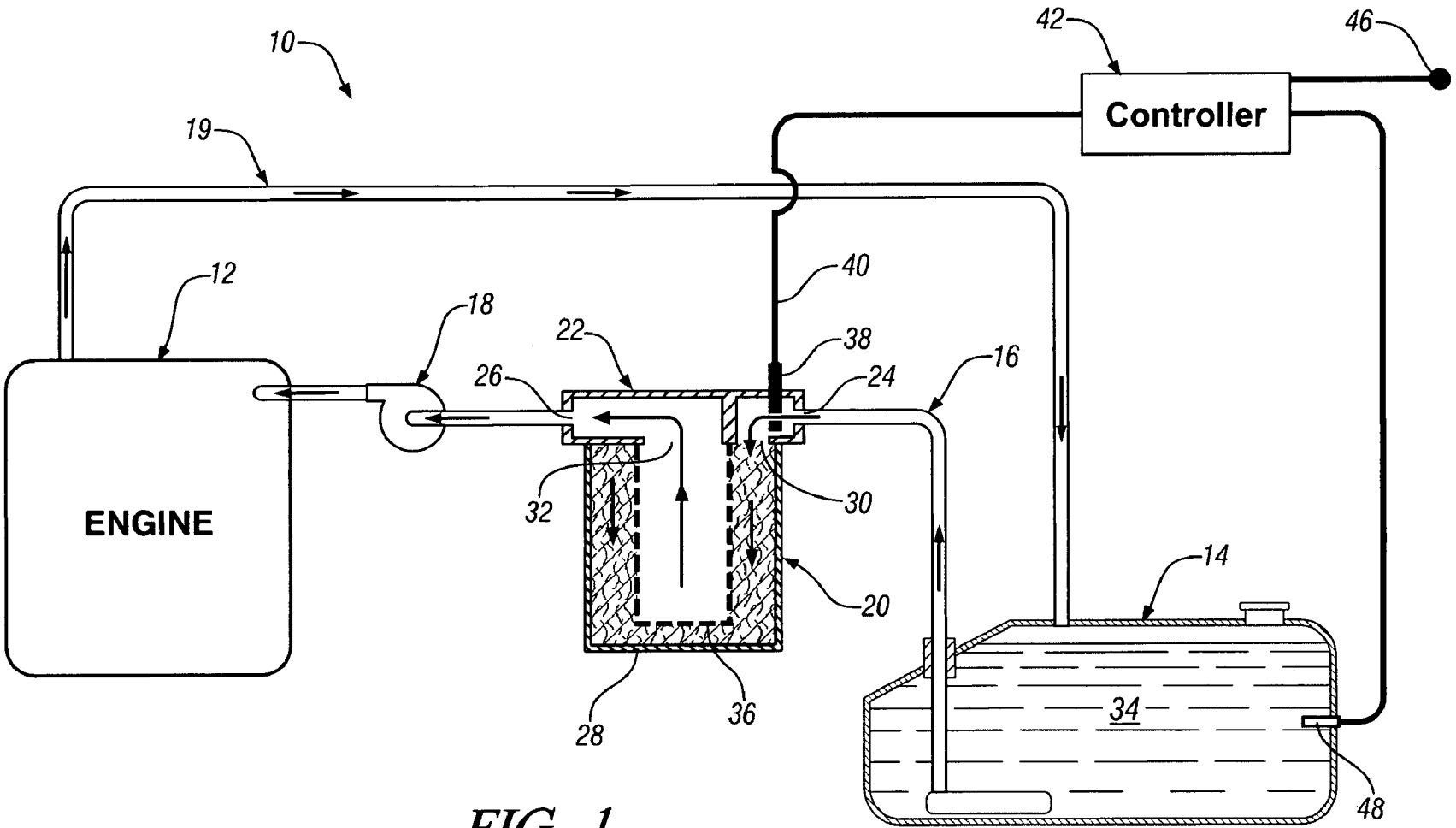
FIG. 1 is a schematic view of a fuel system for use with an internal combustion engine embodying the present invention.

In accordance with an exemplary embodiment of the present invention a fuel system 10 for an in internal combustion engine such as diesel engine 12 is illustrated in FIG. 1. The fuel system 10 comprises a fuel tank 14 and a fuel conduit 16 configured to transport fuel from the fuel tank 14 to the various components of the fuel system 10. Associated with the fuel conduit is a fuel pump 18 that is configured to draw fuel 34 from the fuel tank 14 and to pressurize the fuel to a suitable level for injection into the diesel engine 12 by fuel injectors (not shown). A fuel return line 19 returns excess fuel from the fuel injectors to the fuel tank 14. Also associated with the fuel conduit 16 is a fuel filter assembly 20. The fuel filter assembly 20 may include a fuel manifold 22 having an inlet 24 and an outlet 26 in fluid communication with fuel conduit 16. A fuel filter housing 28 is configured for attachment to the fuel manifold 22 and has an inlet 30 and an outlet 32 for fluid connection with the inlet 24 and outlet 26 of the fuel manifold 22. The fuel filter housing 28 may be permanently attached to the fuel filter manifold 22 such as by welding or the like or it may be removable for easy replacement. When attached to the fuel manifold 22, the fuel filter housing 28 and associated inlet and outlets 24, 26 respectively, define a fuel passage for fuel 34 through the fuel filter assembly 20.

Disposed within the fuel filter housing 28 is a filter element 36. The filter element may be of a fibrous, paper, screen or other suitable configuration or material for removal of contaminants suspended in the fuel 34. The filter element 36 is disposed within the fuel filter housing 28 intermediate of the inlet 30 and the outlet 32 such that fuel 34 flowing through the fuel filter assembly 20 must pass through the filter element as it flows from the filter inlet 30 to the filter outlet 32.

In a non-limiting embodiment, an ultrasonic transducer 38 is configured for installation in the fuel manifold 22. The ultrasonic transducer is configured to emit high frequency acoustic or pressure waves when activated through via controller 42. In a non-limiting embodiment, the wave frequency of the high frequency acoustic or pressure waves are in the ultrasonic range that may include a range of about 20 kHz to about 200 MHz with the actual frequency selected for effective break down of wax crystals suspended in the fuel, as is described in further detail below. The ultrasonic transducer 38 is preferably installed adjacent to, or in close proximity with the inlet 24 of the fuel manifold 22 such that the high frequency acoustic or pressure waves operate on fuel 34 resident in the fuel manifold 22 to reduce, via ultrasonic cavitation, wax crystals prior to their entry into the fuel filter housing 28. Due to the high power requirements required to generate waves in the ultrasonic range, the ultrasonic transducer 38 may be placed in direct, fluid contact with the fuel 34 in the manifold 22 to improve the reduction of the wax crystals suspended therein. The physical reduction in size of suspended wax crystals via the high frequency acoustic or pressure waves emitted by the ultrasonic transducer 38, allows the wax crystals to pass through the filter element 36 without being trapped by or adhering to the filter element. Blockage of the fuel filter element is thereby prevented and unrestricted flow of fuel 34 to the fuel system of the diesel engine 12 is facilitated.

The operation of the ultrasonic transducer 38, may be initiated by the controller 42, based upon a determination of the ambient temperature via temperature sensor 46, upon determination of the fuel temperature in the fuel tank 14 via temperature sensor 48, or via other conditions which may affect the stability of the fuel 34 with respect to the occurrence of waxing therein. If the controller 42 determines the fuel is at or below a predetermined temperature at which waxing of the fuel is likely to occur, the ultrasonic transducer 38 is activated by the controller and the fuel 34 entering the fuel filter assembly 20 is subject to the high frequency waves.

Figure 2:
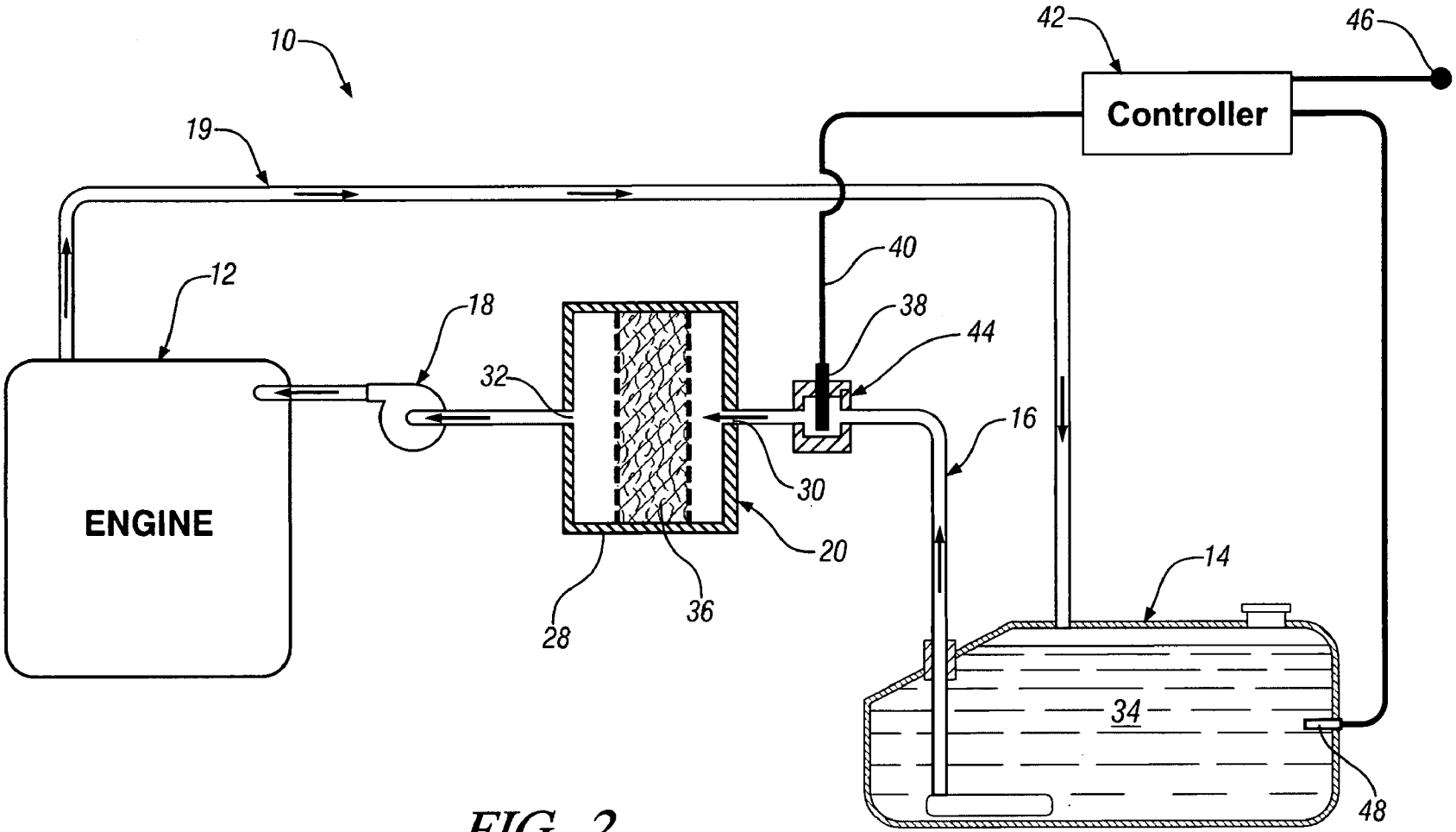
FIG. 2 is schematic view of a second embodiment of a fuel system for use with an internal combustion engine embodying the present invention.

In another embodiment of the invention shown in FIG. 2, in which like numerals are used to denote like features already described, an ultrasonic transducer 38 is configured for installation into a transducer manifold 44 associated with fuel conduit 16. The transducer manifold 44 is preferably located in close, upstream proximity to the inlet 30 of fuel filter housing 28. As indicated, the ultrasonic transducer is configured to emit high frequency acoustic or pressure waves when activated via controller 42. The high frequency acoustic or pressure waves which, in a non-limiting embodiment may be in the ultrasonic range of about 20 kHz to about 200 MHz, operate on the fuel 34 resident in the transducer manifold 44, directly upstream of the inlet 30 of the fuel filter 20 to reduce, via ultrasonic cavitation, wax crystals prior to their entry into fuel filter. The reduction of the wax crystals, via the high frequency acoustic or pressure waves emitted by the ultrasonic transducer 38 prevents blockage of the fuel filter element 36 thereby allowing unrestricted flow of fuel 34, to the fuel system of the diesel engine 12.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments disclosed as the best mode contemplated for carrying out this invention, but that the invention will include all embodiments falling within the scope of the present application.

What is claimed is:

1. A fuel filter assembly for filtering fuel for an internal combustion engine comprising:

a filter housing containing a filter element;

a fuel manifold attached to the filter housing; and an ultrasonic transducer configured to treat the fuel by emitting high frequency acoustic or pressure waves operable on wax crystals suspended in the fuel to reduce the size of the wax crystals via ultrasonic cavitation, and positioned such that the filter housing and filter element receive fuel that has been treated by the ultrasonic transducer from the fuel manifold.

2. The fuel filter assembly for filtering fuel for an internal combustion engine of claim 1, further comprising;

a controller configured to initiate operation of the ultrasonic transducer based upon a condition affecting the fuel.

3. The fuel filter assembly for filtering fuel for an internal combustion engine of claim 2, wherein a condition affecting the stability of the fuel includes ambient temperature.

4. The fuel filter assembly for filtering fuel for an internal combustion engine of claim 2, wherein a condition affecting the stability of the fuel includes fuel temperature.

5. The fuel filter assembly for filtering fuel for an internal combustion engine of claim 1, wherein the high frequency acoustic or pressure waves are in the ultrasonic range of about 20 kHz to about 200 MHz.

6. A fuel system for an internal combustion engine comprising;

a fuel reservoir;

a fuel pump configured to withdraw fuel from the fuel reservoir through a fuel conduit fluidly communicating the reservoir and the fuel pump;

a fuel filter in fluid communication with the fuel conduit comprising a fuel manifold having a fuel inlet and a fuel outlet for receipt of fuel from the fuel conduit and return of fuel to the fuel conduit; and an ultrasonic transducer associated with the fuel manifold and configured to treat the fuel by emitting high frequency acoustic or pressure waves operable on the fuel to reduce the size of wax crystals suspended in the fuel via ultrasonic cavitation and positioned such that the fuel filter receives fuel that has been treated by the ultrasonic transducer from the fuel manifold.

7. The fuel system for an internal combustion engine of claim 6, further comprising;

a controller configured to initiate operation of the ultrasonic transducer based upon a condition affecting the stability of the fuel.

8. The fuel system for an internal combustion engine of claim 7, wherein a condition affecting the stability of the fuel includes ambient temperature.

9. The fuel system for an internal combustion engine of claim 7, wherein a condition affecting the stability of the fuel includes fuel temperature.

10. The fuel system for an internal combustion engine of claim 6, wherein the high frequency acoustic or pressure waves are in the ultrasonic range of about 20 kHz to about 200 MHz.

11. A fuel system for an internal combustion engine comprising;

a fuel reservoir;

a fuel pump for withdrawal of fuel from the fuel reservoir through a fuel conduit fluidly communicating the reservoir and the fuel pump;

a fuel filter in fluid communication with the fuel conduit comprising a fuel inlet and a fuel outlet for receipt of fuel from the fuel conduit and return of fuel to the fuel conduit; and an ultrasonic transducer disposed adjacent to the fuel inlet and configured to treat the fuel by emitting high frequency acoustic or pressure waves operable on wax crystals suspended in the fuel to reduce the size of the wax crystals via ultrasonic cavitation and positioned such that the fuel filter receives fuel that has been treated by the ultrasonic transducer.

12. The fuel system for an internal combustion engine of claim 11, further comprising;

a transducer manifold in fluid communication with the fuel conduit and disposed upstream of the fuel filter, the transducer manifold configured to receive the ultrasonic transducer therein.

13. The fuel system for an internal combustion engine of claim 12, further comprising;

a controller configured to initiate operation of the ultrasonic transducer based upon conditions affecting the stability of the fuel.

14. The fuel system for an internal combustion engine of claim 13, wherein a condition affecting the stability of the fuel includes ambient temperature.

15. The fuel system for an internal combustion engine of claim 14, wherein a condition affecting the stability of the fuel includes fuel temperature.

16. The fuel filter assembly for an internal combustion engine of claim 12, wherein the high frequency waves are in the ultrasonic range of about 20 kHz to about 200 MHz.

* * * * *